United States Patent [19]

Peterseil

[11] Patent Number: 4,482,875

[45] Date of Patent: Nov. 13, 1984

[54] POLARIZED ELECTROMAGNETIC MIDGET RELAY

[76] Inventor: Hartger Peterseil, Emil-Geis-Str. 12, 8000 Munchen 70, Fed. Rep. of Germany

[21] Appl. No.: 388,742

[22] Filed: Jun. 15, 1982

[30] Foreign Application Priority Data

Jun. 22, 1981 [DE] Fed. Rep. of Germany ..... 3124412

[51] Int. Cl.[3] ..... H01H 51/27

[52] U.S. Cl. ..... 335/81; 335/79; 335/83

[58] Field of Search ..... 335/78, 79, 81, 181, 335/83, 196, 230

[56] References Cited

U.S. PATENT DOCUMENTS

| | | | |
|---|---|---|---|
| 2,752,450 | 7/1956 | Foulkes et al. | 335/92 |
| 2,923,792 | 2/1960 | Fry | 335/83 |
| 3,150,244 | 9/1964 | Nitsch et al. | 335/196 |
| 3,227,840 | 1/1966 | Reed et al. | 335/79 |
| 3,922,625 | 11/1975 | Hall | 335/196 |
| 4,367,449 | 1/1983 | Veisz et al. | 335/78 |

FOREIGN PATENT DOCUMENTS

| | | | |
|---|---|---|---|
| 113881 | 2/1942 | Sweden | 335/81 |
| 1021047 | 5/1963 | United Kingdom . | |

*Primary Examiner*—William M. Shoop
*Attorney, Agent, or Firm*—Austin R. Miller

[57] ABSTRACT

A polarized electromagnetic relay has a switching armature inside the bobbin and mounted for movement with the armature free end extending between oppositely arranged contacts defining electrical and magnetic poles, the armature being coupled to a magnet inside the bobbin with the coil core connected to the bobbin formed of a ferromagnetic material and defining a pair of facing opposite magnetic poles constituting the opposite contacts.

11 Claims, 4 Drawing Figures

POLARIZED ELECTROMAGNETIC MIDGET RELAY

The present invention relates to a polarized electromagnetic midget relay, comprising a pair of magnet or field coils positioned within a case and each including a magnetizable coil core, with the longitudinal axes of said coil cores being substantially aligned with each other, and said coil cores defining between their facing ends a contact gap forming part of a contact space defined between said magnet coils, and further comprising a leaf or plate armature acting as a switch, said plate armature being mounted for movement within said contact space and having its free end extending into said contact gap.

A polarized electromagnetic midget relay of this type is known from British Pat. No. 1,021,047. According to one embodiment of this conventional structure, the armature portion which in fact constitutes the movable contact of the midget relay, is peripherally mounted by the material of the relay case, such that the armature portion may assume also a neutral position in which it is out of contact with any of the coil cores. Further, this conventional relay is operated such that either the left field or magnet coil is excited to attract the armature against the associated left coil core, or the right magnet coil is excited to attract the armature against the associated right coil core. Thus, it is of disadvantage in this prior structure that a current is always required to flow across one of the magnet coils to establish a contact between the armature and one of the cores, in order to keep the armature in a contacting position. Still further, the attractive power between the coil core and the armature is relatively weak, because the displacement of the armature is in either case effected by one coil and one core only, whereas the other core and the other coil, respectively, do not have any effect in such operation. Furthermore, this conventional structure also involves the risk that the sheet-like armature would break after a limited number of switching operations, because the armature is bent in itself in every switching movement.

The same drawback exists in the armored electromagnetic relay according to German Pat. No. 543,589 wherein an armature is centrally positioned interiorly of a coil, which armature is formed with a disc-like configuration and supported by a sheet- or leaf-shaped, non-magnetic spring mounted to an interiorly positioned pole piece.

Swiss Pat. No. 491,490 shows to be known a structure for the stabilization of an armature associated with an electromagnetic system and formed without a stationary or fixed fulcrum, in which the essential feature resides in the fact that the armature and the pole plates operatively contacting the armature are each provided with curvatures in order to return the armature to its nominal position within a few switching cycles when the armature has been decentered by mechanical shocks.

Published German patent application No. 2,347,471 shows to be known a polarized electromagnetic relay comprising a magnet coil and a permanent magnet and, further, an armature formed of a magnetizable material. In this prior construction, however, the available interior space of the case is not utilized economically, since the permanent magnet is positioned at the left hand end of the case, whereas the single magnet or field coil is disposed at the right hand end of the case. Further, the various components or parts provided within the case are of a relatively complicated configuration such that manufacture of this prior relay is relatively expensive. Moreover, this prior relay further does not allow quick change over to be effected, because one leg or contact is securely connected directly to the pole of the permanent magnet, with the leg or contact normally consisting of a magnetizable material the magnetic reversal of which is difficult.

Finally, laid-open German patent application No. 2,040,291 shows to be known a driving or operating system for a bistable magnetic relay which uses an armature in the form of a permanent magnet which is pivotally mounted to the end of a coil core in the manner of a rocker.

The object which the present invention is based upon can be seen in improving the polarized electromagnetic midget relay of the type as defined above in such a way that, with the relay being of simple structural configuration, an extremely small current is sufficient to provide an extremely high switching power and, thus, quick response of the relay.

In a first embodiment of the invention this object is solved in that (a) said pair of magnet coils are disposed on a bobbin and have their windings electrically connected in series;

(b) said plate armature is pivotally mounted with one side thereof to the pole face of a permanent magnet; and (c) said permanent magnet is positioned in the contact space in such a manner that the magnetic flux of said permanent magnet is closed across said plate armature and, depending on the switching position of the latter, across one of the coil cores and the magnetic flux circuit of the associated magnet coil.

In a second embodiment of the invention the above object is solved in that (a) said pair of magnet coils are disposed on a bobbin and have their windings electrically connected in series;

(b) said plate armature comprises a permanent magnet which adheres to a mounting position under its magnetic force; and (c) said plate armature is positioned in said contact space in such a manner that, depending on the switching position of said plate armature, the magnetic flux thereof is closed across one of said coil cores and the magnetic flux circuit of the associated magnet coil.

In contrast with the conventional constructions, the magnet or field coils of the structure according to the present invention comprise a pair of serially connected magnet coils, whereby the switching operation is always effected by the cooperation of a pair of magnet coils, such that only a relatively small current is sufficient to effect quick switching or change over of the relay.

Furthermore, the electromagnetic midget relay according to the present invention may be manufactured easily and at low cost.

Particularly preferable embodiments and further developments of the present invention are disclosed in the sub-claims.

Below, the present invention is explained in an exemplary embodiment with reference to the enclosed drawing, wherein.

Figure 1:
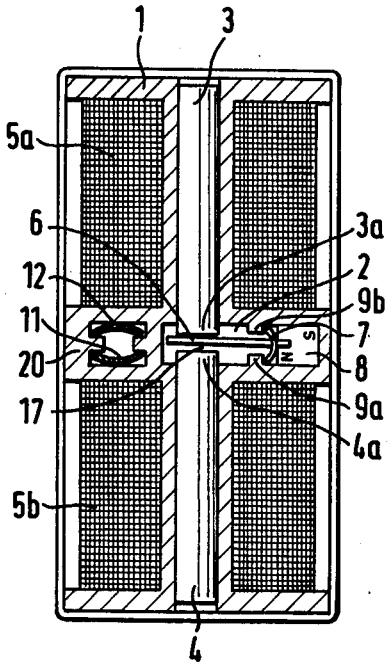
FIG. 1 is a longitudinal sectional view of a midget relay with the case cap or cover removed.
Figure 3:
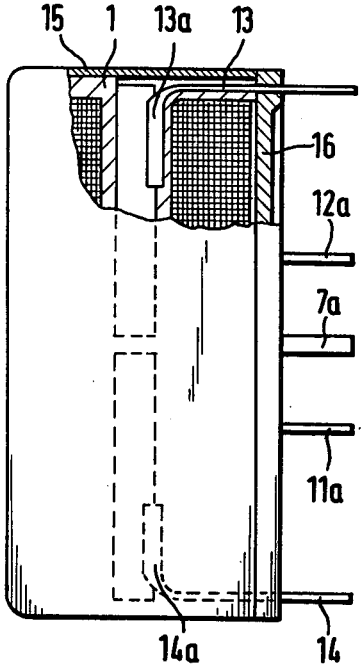
FIG. 3 is a side elevational view, partly in section, of a midget relay.
Figure 2:
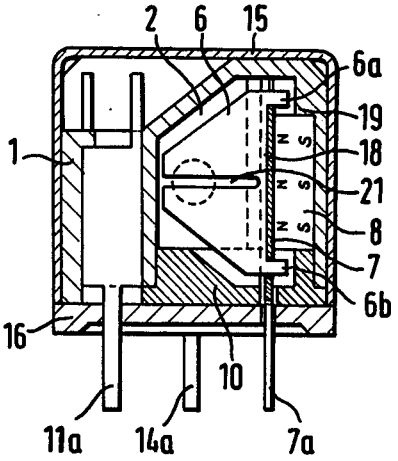
FIG. 2 is a cross-sectional view of the midget relay to illustrate the contact compartment (space) according to the embodiment of FIG. 1.
Figure 4:
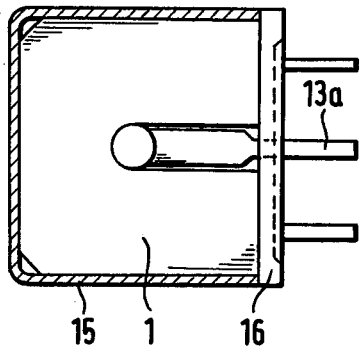
FIG. 4 is a side elevational view of a midget relay with the case cap or cover cut open.

FIGS. 1 to 4 illustrate an exemplary embodiment of of polarized midget relay comprising a bobbin 1 the winding space of which is radially interrupted by a flange 20 of small width and in which there is provided a contact space 2 into which a pair of coil cores 3, 4 of ferromagnetic material extend with one end thereof each, which coil cores, when excited, define a pair of unlike (opposite) magnetic poles facing each other with a given spacing between them and defining the contact gap 17 and the opposite contacts 3*a*, 4*a*.

A leaf or plate armature 6 is positioned whithin the contact space 2 perpendicular to the coil or bobbin axis, with the free end of said armature being disposed between the ends of coil cores 3, 4 constituting the opposite contacts 3*a*, 4*a*. At the front end, opposite from the free end, i.e. the mounting end face 18, the plate armature 6 is provided with a pair of guide tabs 6*a*, 6*b* which extend into corresponding (complementary) slots of a guide element 7 to guide the plate armature during its switching movements. The guide element 7 is coupled to a pole face of a permanent magnet 8 being polarized in a direction normal to the coil or bobbin axis, and held in its functional position in the contact space 2, together with the permanent magnet, by a pair of retainer ribs 9*a*, 9*b*. Under the magnetic force of the permanent magnet 8, the plate armature 6 has its mounting front face 18 adhered to or attracted against the guide element 7, such that a permanent electrical contact coupling is established between these two parts, whereby the plate armature 6 includes as electrical connection to the exterior through a terminal pin 7*a* of the guide element 7.

The permanent magnet 8 is supported in its longitudinal direction by a protrusion 19 provided within the contact space 2 so as to be permanently fixed in this position by a closure element 10 which at the same time seals the contact space 2.

Adjoining the contact space 2 are mounting elements for a pair of solder pins 11, 12 serving as terminals or connectors of the magnet coils 5*a*, 5*b* and which are led out of the case through terminal pins 11*a*, 12*a*.

At the front faces of the bobbin 1, the current-carrying coil cores 3, 4 are each provided with an angled connector or terminal pin 13, 14 constituting the electrical connection to the opposite contacts. Positive electrical contact making of the terminal pins 13, 14 with the coil cores 3, 4 is obtained by pressure contact of the contact faces 13*a*, 14*a* being formed with a dished configuration conforming to the radius of the coil cores 3, 4, when these latter two members are pressed into the bobbin 1.

By a ferromagnetic case cap or cover 15 enclosing the bobbin 1 on five sides thereof, the magnetic resistance in the exciter flux circuit is reduced to a minimum, while at the same time the flux circuit of the permanent magnet 8 is closed, in advantageous manner, through the plate armature 6 and the coil core 3 or the coil core 4, depending on the switching position of the plate armature 6.

The underside of the relay is formed by a closure frame 16 being provided with openings arranged with a lead-wire spacing for connector or terminal pins and including holes for the filling in of a sealing compound which fills out the free space between the bobbin 1 including its magnet coils 5*a*, 5*b* and the case cap or cover 15, but which primarily seals the contact space 2 in gas-tight manner.

I claim:

1. A polarized electromagnetic midget relay, comprising a pair of magnet or field coils positioned within a case and each including a magnetizable coil core, with the longitudinal axes of said coil cores being substantially aligned with each other, and said coil cores defining between their facing ends a contact gap forming part of a contact space defined between said magnet coils, and further comprising a leaf or plate armature acting as a switch, said plate armature being mounted for movement within said contact space and having its free end extending into said contact gap, characterized in that (a) said pair of magnet coils (5*a*, 5*b*) are disposed on a bobbin and have their windings electrically connected in series;

(b) said plate armature (6) is pivotally mounted with one side thereof to the pole face of a permanent magnet (8) and includes a pair of guide tabs (6*a*, 6*b*) at the corners of its mounting end face, which tabs extend into corresponding slots of a guide element (7), and that said guide element (7) is provided with an electrical terminal pin (7*a*); and (c) said permanent magnet (8) is positioned in the contact space (2) in such a manner that the magnetic flux of said permanent magnet is closed across said plate armature (6) and, depending on the switching position of the latter, across one of the coil cores (3 or 4) and the magnetic flux circuit of the associated magnet coil (5*a*, 5*b*).

2. The relay according to claim 1, characterized in that said contact faces and said mounting end face (18) of said plate armature (6) as well as the ends of said coil cores (3, 4), which ends constitute said opposite contacts, are provided with a contact material.

3. The relay according to claim 1, characterized in that said plate armature (6) and said coil cores (3, 4) are completely formed of a material having good ferromagnetic characteristics and being also a suitable contact material, and wherein said guide element (7) is formed of a material suitable for electrical contacts.

4. The relay according to claim 1, characterized in that said contact space extends only across a part of the cross-sectional area of the relay.

5. The relay according to claim 4, characterized in that said contact space (2) is sealed by a closure element (10).

6. The relay according to claim 1, characterized in that said plate armature (6) is provided with a slit (21), in a manner similar to a contact spring.

7. The relay according to claim 1, characterized in that said coil cores (3, 4) are connected to angled terminal pins (13, 14).

8. The relay according to claim 7, characterized in that the electrical connection of said terminal pins (13, 14) to said coil cores (3, 4) is defined by contact faces (13*a*, 14*a*) conforming to the shape of said coil cores (3, 4).

9. The relay according to claim 7, characterized in that said terminal pins (13, 14) are welded to said coil cores (3, 4).

10. The relay according to claim 1, characterized in that the case is a ferromagnetic flux conducting cover which surrounds four sides of said bobbin (1).

11. The relay according to claim 1, characterized in that the case is a ferromagnetic flux conducting cover (15) which encloses five sides of said bobbin (1).

* * * * *